US010327064B2

(12) United States Patent
Starobin

(10) Patent No.: US 10,327,064 B2
(45) Date of Patent: Jun. 18, 2019

(54) METHOD AND SYSTEM FOR IMPLEMENTING STEREO DIMENSIONAL ARRAY SIGNAL PROCESSING IN A COMPACT SINGLE ENCLOSURE ACTIVE LOUDSPEAKER PRODUCT

(71) Applicant: POLK AUDIO, LLC, Vista, CA (US)

(72) Inventor: Bradley M. Starobin, Baltimore, MD (US)

(73) Assignee: POLK AUDIO, LLC, Vista, CA (US)

( * ) Notice: Subject to any disclaimer, the term of this patent is extended or adjusted under 35 U.S.C. 154(b) by 0 days.

(21) Appl. No.: 15/796,303

(22) Filed: Oct. 27, 2017

(65) Prior Publication Data

US 2018/0192185 A1 Jul. 5, 2018

Related U.S. Application Data

(60) Provisional application No. 62/413,782, filed on Oct. 27, 2016.

(51) Int. Cl.

| | |
|---|---|
| ***H04R 5/00*** | (2006.01) |
| ***H04R 1/28*** | (2006.01) |
| ***H04R 1/02*** | (2006.01) |
| ***H04R 3/12*** | (2006.01) |
| *H04R 5/02* | (2006.01) |
| *H04R 1/40* | (2006.01) |
| *H04R 5/04* | (2006.01) |

(52) U.S. Cl.

CPC ..... *H04R 1/2892* (2013.01); *H04R 1/025* (2013.01); *H04R 3/12* (2013.01); *H04R 1/403* (2013.01); *H04R 5/02* (2013.01); *H04R 5/04* (2013.01); *H04R 2201/401* (2013.01); *H04R 2205/022* (2013.01); *H04S 2420/01* (2013.01)

(58) Field of Classification Search

CPC ..... H04R 1/2892; H04R 1/025; H04R 5/02; H04R 2201/401; H04R 2205/022

USPC ..... 381/300, 304–305, 119, 345, 386

See application file for complete search history.

(56) References Cited

U.S. PATENT DOCUMENTS

| | | | |
|---|---|---|---|
| 4,489,432 | A | 12/1984 | Polk |
| 4,497,064 | A | 1/1985 | Polk |
| 4,569,074 | A | 2/1986 | Polk |

(Continued)

*Primary Examiner* — Disler Paul

(74) *Attorney, Agent, or Firm* — McKinney & Associates, LLC; J. Andrew McKinney, Jr.

(57) ABSTRACT

A single enclosure multi-channel loudspeaker product 100 uses a novel signal processing system and method to achieve a surprisingly effective psycho-acoustically expanded image breadth by inter-aural crosstalk cancellation, in a manner which relies on a new method for cancellation of apparent sources of inter-aural crosstalk. In the commonly owned Polk® SDA™ (prior art) method, the optimal distance between stereo pair main and effect (SDA) loudspeakers was required to be substantially equal to the ear-to-ear width of a typical user's head. Compact SDA speaker system 100 employs digital signal processing generating selected time delays to acoustically simulate the optimal placement of an effects transducer relative to its main transducer for a physically compact configuration having each side's "main" transducer (e.g., 108LMS) spaced at less than 5.5 inches from the side's corresponding SDA (or effects) transducer (e.g., 108LSS), and this permits the system enclosure to be surprisingly compact, (e.g., width of as little as 341.2 mm).

17 Claims, 10 Drawing Sheets

(56) References Cited

U.S. PATENT DOCUMENTS

| | | | | |
|---|---|---|---|---|
| 6,937,737 | B2 | 8/2005 | Polk | |
| 7,231,053 | B2 | 6/2007 | Polk | |
| 7,817,812 | B2 | 10/2010 | Polk et al. | |
| 8,175,304 | B1 * | 5/2012 | North | H04R 1/403 381/17 |
| 8,553,914 | B2 * | 10/2013 | Fletcher | H04S 1/002 381/300 |
| 9,185,490 | B2 | 11/2015 | Starobin | |
| 9,374,640 | B2 | 6/2016 | Starobin | |
| 2009/0175476 | A1 * | 7/2009 | Bottum | H04R 5/02 381/335 |
| 2011/0216925 | A1 * | 9/2011 | Riggs | H04R 5/02 381/300 |
| 2011/0243353 | A1 * | 10/2011 | Takumai | H04R 1/403 381/300 |
| 2014/0161286 | A1 * | 6/2014 | Kohn | H04R 3/00 381/151 |
| 2015/0189439 | A1 * | 7/2015 | Starobin | H04R 3/12 381/303 |

* cited by examiner

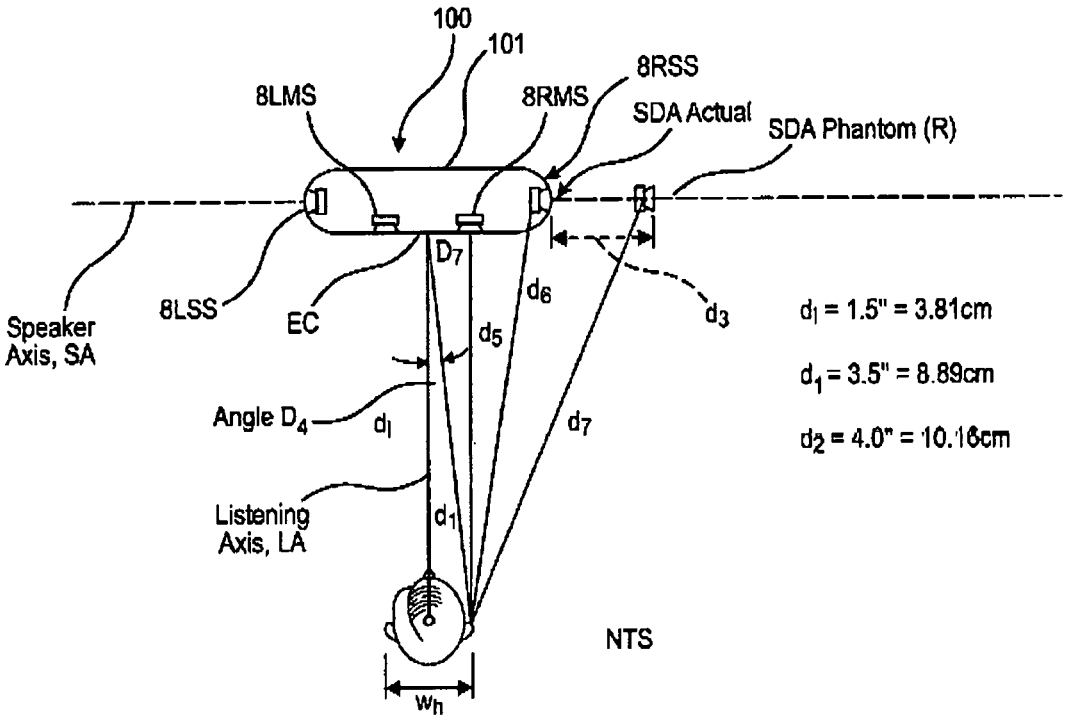

$d_l$ = listening distance as shown $d_1$ = distance between center of loudspeaker & "main" transducer of main/SDA pair $d_2$ = distance between acoustic center of main transducer & its SDA counterpart (actual position)

$d_3$ = distance between acoustic centers of actual and ideal (phantom) SDA transducers $d_4$ = distance from right ear to loudspeaker $d_5$, $d_6$, $d_7$ = distance between listener (right ear) & acoustic center of main ($d_5$), actual SDA ($d_6$) & phantom SDA ($d_7$) transducer $w_h$ = width of human head (distance between ears)

FIG. 4A

Note: Certain HPF and PEQ filters imposed on L & R signals that are immaterial to this patent are not shown Notes:
1: Left & Right (front) channels are processed per stereo SDA algorithm
2: Center channel processing (HPF, PEQ, LPF) is immaterial to patent & not shown;
in accordance with patent 9,374,640 (Starobin) all transducers reproduce center channel program metrics as a line array

METHOD AND SYSTEM FOR IMPLEMENTING STEREO DIMENSIONAL ARRAY SIGNAL PROCESSING IN A COMPACT SINGLE ENCLOSURE ACTIVE LOUDSPEAKER PRODUCT

PRIORITY CLAIM AND REFERENCE TO RELATED APPLICATIONS

This application is a continuation of and claims priority to commonly owned U.S. Patent application No. 62/413,782, filed Oct. 27, 2016, the entire disclosure of which is hereby incorporated herein by reference. This application is also related to commonly owned U.S. patent application Ser. No. 14/563,508, now U.S. Pat. No. 9,374,640, entitled "Method and System for Optimizing Center Channel Performance in a Single Enclosure Multi-Element Loudspeaker Line Array", the entire disclosure of which is hereby incorporated herein by reference. The subject matter of this invention is also related to the following commonly owned applications:
Ser. No. 06/383,151, now U.S. Pat. No. 4,489,432,
Ser. No. 06/405,341, now U.S. Pat. No. 4,497,064,
Ser. No. 06/616,249, now U.S. Pat. No. 4,569,074,
Ser. No. 10/692,692, now U.S. Pat. No. 6,937,737,
Ser. No. 11/147,447, now U.S. Pat. No. 7,231,053, and
Ser. No. 13/295,972, now U.S. Pat. No. 9,185,490, the entireties of which are incorporated herein by reference, for purposes of providing background information and nomenclature.

BACKGROUND OF THE INVENTION

Field of the Invention

The present invention relates to reproduction of sound in multichannel systems generically known as "surround-sound" or "stereo" systems and more specifically to the application of psychoacoustic and acoustic principles in the design of a multi-driver, compact loudspeaker system located in front of a listening space.

Discussion of the Prior Art

Listeners often use two channel "stereo systems" for music recording playback and "surround-sound" or "home theater" systems for both music playback and other types of audio reproduction.

Surround-sound or home theater loudspeaker systems are configured for use with standardized home theater audio systems which include a plurality of playback channels, each typically served by an amplifier and a loudspeaker. In Dolby™ home theater audio playback systems, there are typically five or more channels of substantially full range material plus a subwoofer channel configured to reproduce band-limited low frequency material. The five substantially full range channels in a Dolby Digital 5.1™ system are typically, center, left front, right front, left surround and right surround. The left front and right front channel loudspeakers are typically positioned in a home theater system near the left and right sides of the video monitor or television and the left front and right front channels are used by content creators for "stereo" (e.g., music) signals and sound effects. For stereo music reproduction, this has the desirable effect of making reproduced music sound as if it emanates from a soundstage which includes the video monitor. For sound effects too, this has the desirable effect of making effects sound as if they emanate from and beyond the video monitor.

Unfortunately, when typical surround sound (e.g., Dolby® 5.1) loudspeaker systems are installed in listener's homes, setup problems are encountered and many users struggle with speaker placement, component connections and related complications. In response, many listeners have turned to "soundbar" style home theater loudspeaker systems which incorporate at least left, center and right channels into a single enclosure configured for use near the user's video display.

These soundbar style single enclosure loudspeaker systems ("soundbars") are simpler to install and connect and can be configured as compact, active loudspeaker products for use almost anywhere. But most soundbars, and especially most compact soundbars provide unsatisfactory performance for listeners who want to listen to movies and music from listening positions arrayed in a typical user's listening space.

One objection encountered when listening to compact active loudspeaker systems is that the breadth, or width, of the acoustic image delivered by a compact stereo (two-channel) source is small or narrow, so there is no sense of a spacious acoustic image which may be enjoyed by listeners in any of the listening locations, even in a limited "sweet spot". If anything like an acoustic image is perceived by a listener, that acoustic image is not "stable" in the sense that "phantom" images presented by the system appear to remain relatively fixed in space even as the listener moves about the listening area. This latter attribute is one hallmark of Matthew Polk's patented SDA™ technology and is a distinguishing characteristic from other spatialization algorithms that depend only on electronic processing techniques, as opposed to dedicated acoustic sources.

Matthew Polk's SDA™ Patents:

Generating a broad and stable acoustic image was the desired goal of Mathew Polk's work as reflected in commonly owned (and now expired) U.S. Pat. Nos. 4,489,432, 4,497,064, and 4,569,074, among others. FIG. 1 is a diagram taken from U.S. Pat. No. 4,497,064 illustrating Mathew Polk's "SDA" loudspeaker system and method, with a stereo pair of "main" left and right channel speakers (LMS, RMS) each including a corresponding "sub" speaker (LSS, RSS), where all four loudspeaker drivers are aligned along a speaker axis in front of a listening location.

Referring again to FIG. 1, a stereophonic sound reproduction system having a left channel output and a right channel output, a right main speaker (RMS) and a left main speaker (LMS) are at right and left main speaker locations which are equidistantly spaced from the listening location. The listening location (shown in the diagram as the top of a listener's head) is defined as a spatial position for accommodating a listener's head facing the main speakers and having a right ear location $R_e$ and a left ear location $L_e$ along an ear axis, with the right and left ear locations separated along the ear axis by a maximum interaural sound distance of $\Delta t_{max}$ and the listening location being defined as the point on the ear axis equidistant to the right and left ears. Right effect or sub-speaker (RSS) and left effect or sub-speaker (LSS) are provided at right and left sub-effect or speaker locations which are equidistantly spaced from the listening location. The right and left channel outputs are coupled respectively to the right and left main speakers. An inverted right channel signal with the low frequency components attenuated is developed and coupled to the left effect or sub-speaker (LSS). And an inverted left channel signal with the low frequency components attenuated is developed and coupled to the right effect or sub-speaker (RSS).

By careful selection of the distance between the main speakers and sub-speakers (W), sound reproduced by the system will have an expanded acoustic image with no reduction of low frequency response as perceived by a listener located at the listening location. In effect, the spacing "W" between the main and effect or "sub" speakers approximates the space between the ears of the listener, which allows an interaural crosstalk cancelling inverted signal from each "sub" speaker to diminish or eliminate cross talk from the left main speaker to the right ear and from the right main speaker to the left ear, and this interaural crosstalk cancellation creates the desired audible "SDA" effect. The problem for modern users is that they may not have enough space for a traditional stereo system with standalone left and right speakers. In the Polk SDA™ systems like that shown in FIG. 1, the optimal distance ("W") between stereo pair main and effect (SDA) loudspeakers was required to be substantially equal to 7.5-8.0" and the length of the speaker axis from end to end (from LSS to RSS) may be over seven feet. Physically small (e.g., compact, single enclosure) loudspeaker systems cannot accommodate a requirement to array speaker drivers along an axis seven feet long with a spacing between main and effects speakers of 8 inches. Instead, contemporary listeners want something which is much smaller, which can easily be placed on a tabletop or in front of a television, for use when listening to two-channel stereo recordings or 5.1 channel home theater program materials.

There is a need, therefore, for a compact loudspeaker system and signal processing method for reproducing audio program material with satisfyingly broad, wide and stable acoustic images for listeners arrayed within a realistically large seating space, regardless of each listener's location relative to the loudspeaker within the listening space.

SUMMARY OF THE INVENTION

Accordingly, it is an object of the present invention to overcome the above mentioned difficulties by providing a method and system for implementing a new form of Stereo Dimensional Array ("SDA™") signal processing which is effective when used in compact loudspeaker products.

The method and system of the present invention preferably implements SDA signal processing not in a "stereo pair" of traditional standalone loudspeakers, but in a compact active (e.g., single enclosure) loudspeaker product which achieves a surprisingly effective psycho-acoustically expanded image breadth by implementing a new type of cancellation for sources of undesirable inter-aural crosstalk. As noted above, in the commonly owned prior Polk SDA™ method, the optimal distance between stereo pair "main" and "effect" (SDA) loudspeaker drivers was required to be substantially equal to 7.5-8.0 inches. Physically small (e.g., compact, single enclosure) loudspeaker systems cannot accommodate this requirement, since the compact enclosure are not wide enough and do not provide adequate front baffle surface area to allow placement of a left front "main" driver spaced 7.5-8 inches from a left SDA "effect" driver, where those two drivers are separated from a corresponding pair of right side "main" and SDA "effect" drivers. Instead, the present invention employs newly developed digital signal processing methods (including an unexpected amount of time delay) to effectively simulate the optimal placement of an effect (SDA) source relative to its main companion source. Additionally, a number of other enhancements are employed to further improve the subjective reproduction of stereo and multi-channel program material.

The present invention required development of signal processing methods which permitted use of multi-driver compact loudspeaker product assembly having, preferably a single enclosure with a substantially vertical wall segment or baffle having a proximal or front surface bounded by a left end opposing a right end, where the enclosure preferably has a left side baffle surface with a symmetrically configured opposing right side surface. In an exemplary embodiment, the compact enclosure is configured as a compact soundbar enclosure having a first forward facing driver positioned laterally near the left end and a second forward facing driver positioned laterally near the right end. The enclosure also preferably has a third driver mounted and aimed laterally on the left side baffle surface with a symmetrically configured fourth driver mounted and aimed laterally on the right side baffle surface, so the third and fourth drivers, being mounted upon the opposing left and right side baffle surfaces are aimed in opposing directions, firing laterally or outwardly to the left and right sides. The first speaker is designated the left "main" speaker (using Polk® SDA™ nomenclature) and the third speaker becomes, if driven with signals modified in accordance with the present invention, the left "sub" or "SDA effect" speaker, where the distance between the left main speaker and the left sub speaker is very small, at approximately twelve centimeters (12 cm, or less than 5 inches) (from first driver diaphragm center to third driver diaphragm center). Similarly, the second speaker is designated the right "main" speaker (using Polk® SDA™ nomenclature) and the fourth speaker becomes, if driven with signals modified in accordance with the present invention, the right "sub" speaker, where the distance between the right main speaker and the right sub speaker is preferably a symmetrically matched 12 cm (from second driver diaphragm center to fourth driver diaphragm center).

Signal processing algorithms programmed into in the compact SDA system of the present invention employ a carefully selected interval of digital delay (preferably in the range of 0.2 to 0.5 milliseconds) to compensate for the very small (and closer than optimal) spacing of main and sub (or SDA cancellation effect generating) transducers, which are oriented laterally (facing outward) as opposed to facing forward. Applicant's work has shown that given their acoustically small dimensions and limited bandwidth, "sub" transducer orientation (e.g., laterally) may not be critically important to generating the desired acoustic image enhancing effect, but it does permit the lateral extent of the enclosure to be smaller than an enclosure with similar performance having all four drivers on a front facing baffle. In an exemplary embodiment the overall transverse width of the compact SDA multi-channel loudspeaker system is 341.2 cm or 13.43 inches.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE FIGURES

FIG. 4A is a diagram illustrating the orientation and configuration of the compact loudspeaker system in a listening space, in accordance with the present invention.

DESCRIPTION OF THE PREFERRED EMBODIMENT

Turning now to FIGS. 2A-6, the present invention as illustrated and described below provides a surprisingly compact multi-channel single enclosure loudspeaker system 100 configured for use with a digital signal processing method for reproducing audio program material with satisfyingly broad, wide and stable acoustic images for listeners in a listening space, regardless of each listener's location relative to the loudspeaker within the listening space.

Figure 2B:
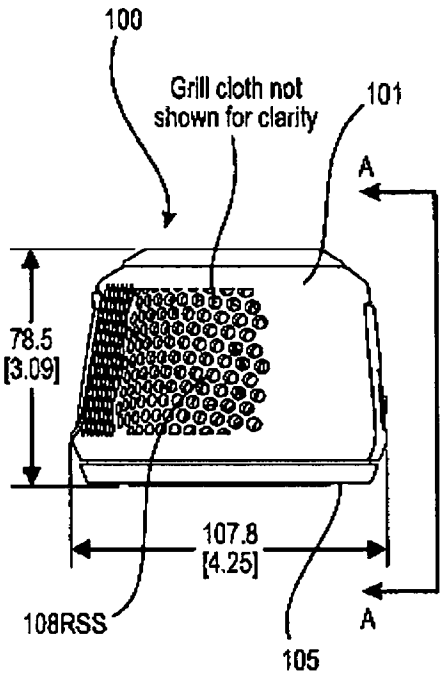
FIGS. 2A and 2B are front and side views in elevation, illustrating a compact single enclosure multi-channel loudspeaker system or product capable of reproducing stereo or 5.1 program material which achieves a surprisingly effective psycho-acoustically expanded image breadth by implementing a new type of cancellation for sources of undesirable interaural crosstalk, in accordance with the present invention.
Figure 2A:
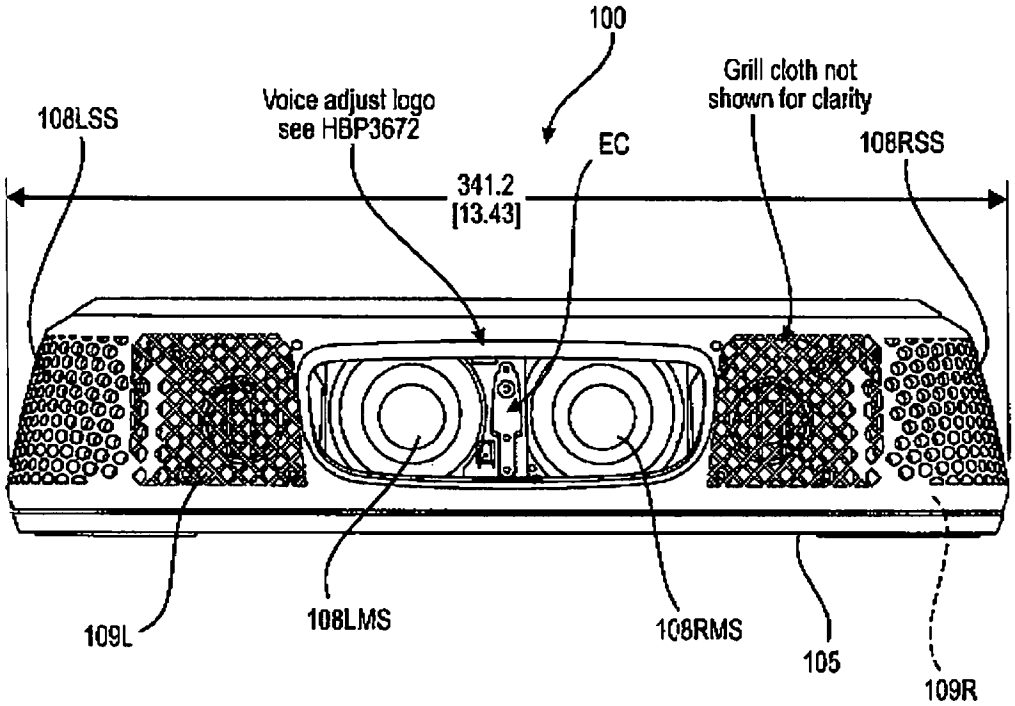
Figure 3:
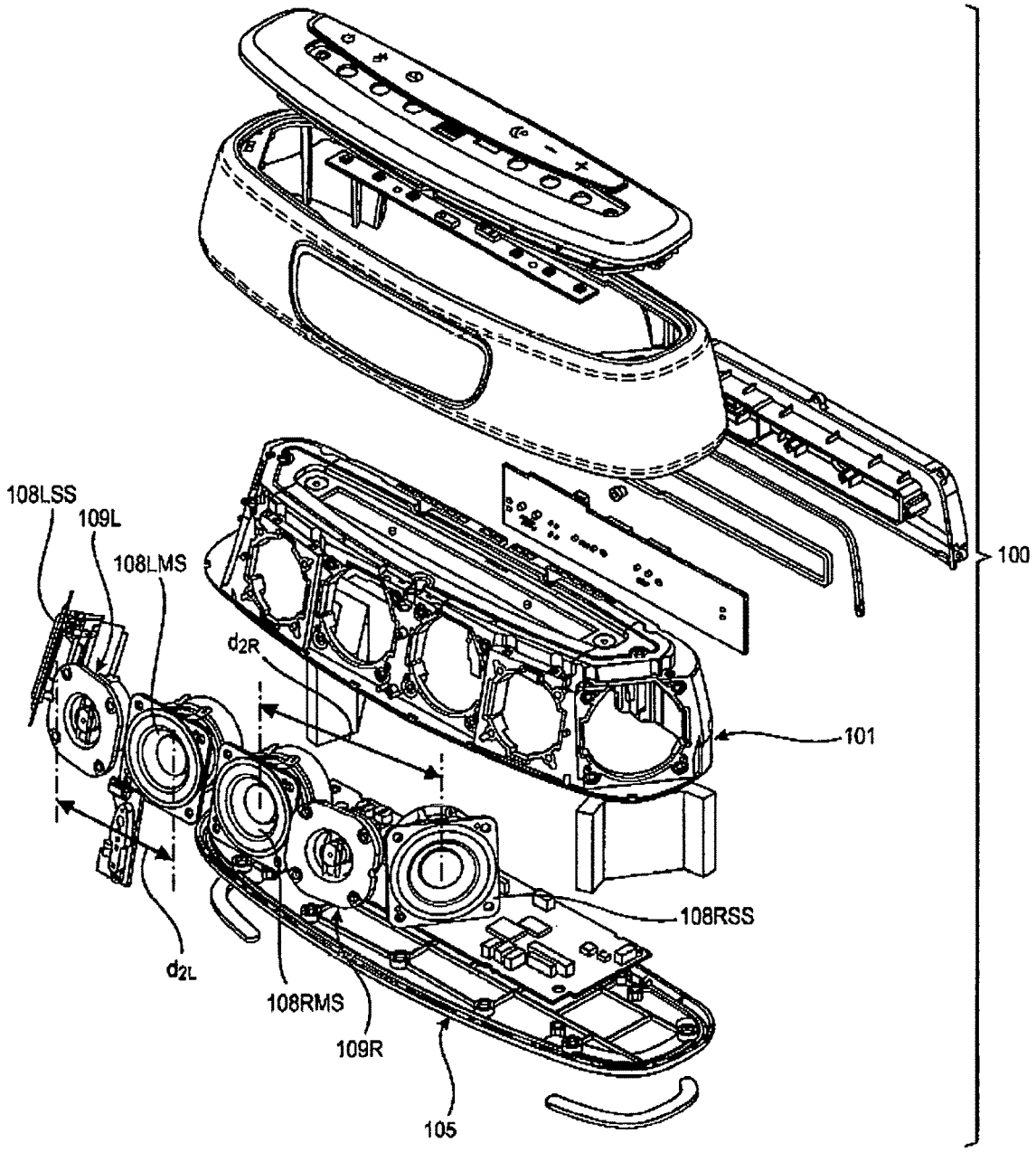
FIG. 3 is an exploded view in perspective illustrating the compact single enclosure loudspeaker system product of FIG. 2, in accordance with the present invention.

Turning first to the compact loudspeaker system 100 illustrated in FIGS. 2A, 2B and 3, a multi-driver compact loudspeaker product assembly has a single chassis including planar bottom cap 105 upon which is mounted enclosure sidewall member 101 with a substantially vertical front wall segment or baffle having a proximal or front surface bounded by a left end opposing a right end, where the enclosure 101 has an angled left side baffle surface with a symmetrically configured opposing angled right side baffle surface. In the illustrated embodiment, the compact enclosure 101 is configured as a compact soundbar enclosure having a first forward facing driver 108LMS positioned laterally left of the enclosure center EC nearer the left end and a second forward facing driver 108RMS positioned laterally right of the enclosure center EC nearer the right end.

The enclosure 101 also aims and supports a third driver 108LSS mounted and aimed laterally on the left side baffle surface with a symmetrically configured fourth driver 108RSS mounted and aimed laterally on the right side baffle surface, so the third and fourth drivers (108LSS, 108RSS) being mounted upon the opposing left and right side baffle surfaces are angled and aimed outwardly or laterally in opposing directions, firing to the left and right sides. The first speaker 108LMS is designated the left "main" speaker (using Polk® SDA™ nomenclature) and the third speaker 108LSS, driven with signals modified in accordance with the present invention, the left "sub" speaker, where the distance $d_{2L}$ between the left main speaker 108LMS and the left sub speaker 108LSS is less than 5.5 inches and preferably approximately 3.5 inches (from first driver acoustic center to third driver acoustic center). A driver's "acoustic center" is the point from which a driver's radiated sound originates and may vary with frequency but typically coincides with the junction connecting a driver's voice coil former to its diaphragm. Similarly, the second speaker 108RMS is designated the right "main" speaker (using Polk® SDA™ nomenclature) and the fourth speaker 108RSS, driven with signals modified in accordance with the present invention, the right "sub" speaker, where the distance $d_{2R}$ between the right main speaker 108RMS and the right sub speaker 108RSS is a symmetrically matched 3.5 inches (from second driver acoustic center to fourth driver acoustic center, see FIG. 3).

Signal processing algorithms programmed into a microprocessor and DSP circuitry included with dedicated power amplifiers (as described below and illustrated in FIGS. 5 and 6) employ a selected interval of digital delay to compensate for the compact (i.e., closer than typically optimal) spacing of main and sub (or SDA cancellation effect generating) transducers, which are oriented laterally (facing outward) as opposed to facing forward. Applicant's work has shown that given their acoustically small dimensions and limited bandwidth, "sub" transducer orientation (e.g., laterally) may not be critically important to generating the desired acoustic image enhancing effect, but it does permit the lateral extent of the enclosure to be small (e.g., less than 400 mm, as illustrated in FIG. 2A) which is certainly smaller than an enclosure with similar performance having all four drivers on a front facing baffle. In the exemplary embodiment illustrated in FIGS. 2A-3, the overall transverse width of the compact SDA multi-channel loudspeaker system or product 100 is 341.2 cm or 13.43 inches.

Figure 1:
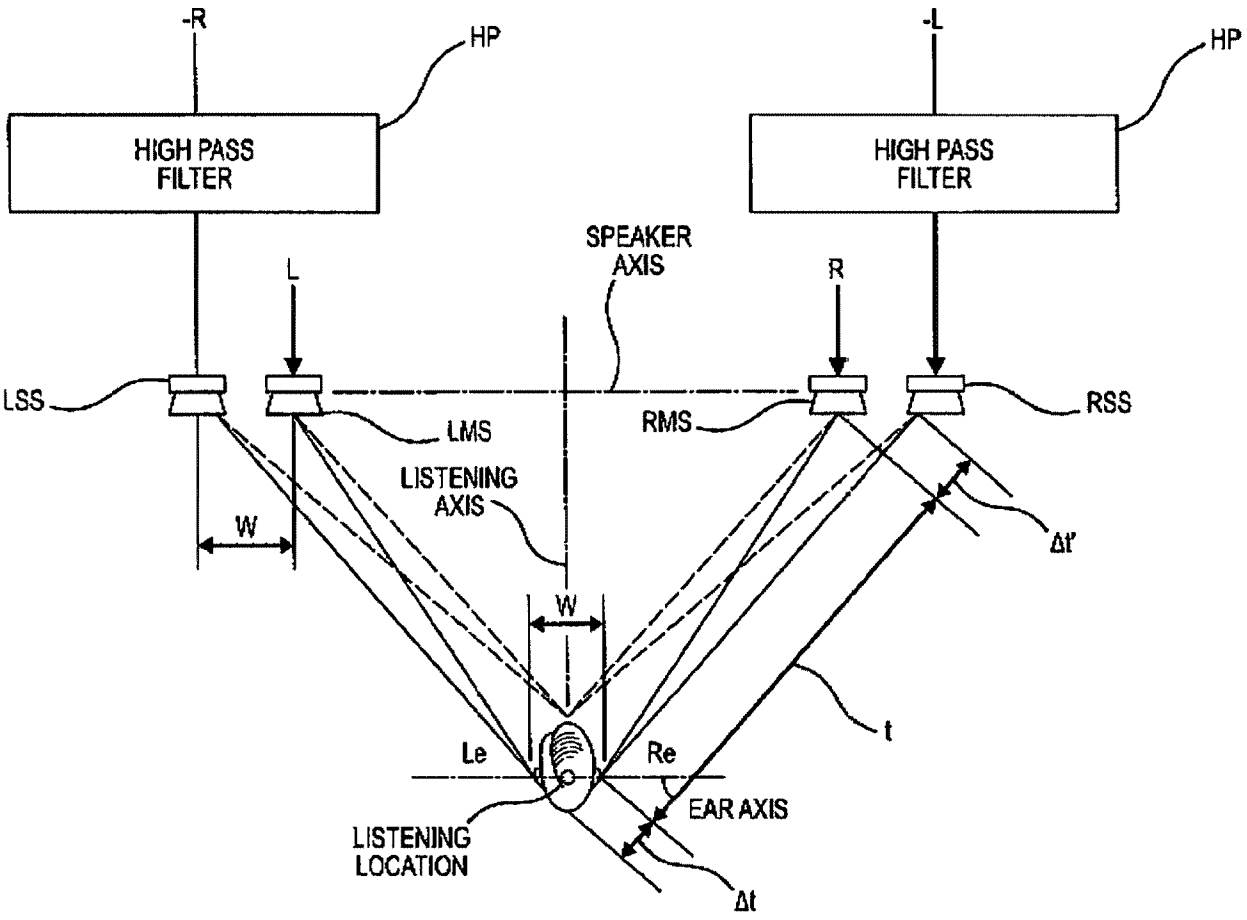
FIG. 1 (Prior Art)
FIG. 1 is a diagram illustrating Mathew Polk's original "SDA" loudspeaker system and method, with a stereo pair of "main" left and right channel speakers (LMS, RMS) each including a corresponding "sub" speaker (LSS, RSS), where all four loudspeaker drivers are aligned along a speaker axis in front of a listening location, in accordance with the prior art.

Turning now to FIG. 4, the nomenclature and configuration of the system and method for computing the most satisfying delays for the present invention bears some similarity to the work done for SDA system of the prior art (as seen in FIG. 1) but with important differences.

FIG. 4A is a diagram illustrating the compact loudspeaker product 100 of the present invention aligned along a lateral speaker axis SA and centered on a transverse listening axis LA, where the listener is at a distance $d_L$ from a front surface of the enclosure and centered on a central axis intersection at EC. The Pythagorean Theorem may be applied to find the distance between the listener's right ear and the center of the loudspeaker product's center, $d_4$, as follows:

$$d_4=(d_{listen}^2+(w_h/2)^2$$

and from Trigonometric identities, $$\sin D_4=(w_h/2)/d_4 \rightarrow D_7=(\text{pi}/2)-D_4$$

The Law of Cosines may be applied to solve for $d_6$ and $d_7$ with respect to triangle ($d_4$,$d_1$+$d_2$,$d_6$) and triangle ($d_4$,$d_1$+$d_2$+$d_3$,$d_7$). Then, $d_7-d_6$ was used to determine the first estimate for an appropriate the time delay to be applied to the SDA driver as a function of the noted variables.

From the Law of Cosines:

$$d_6^2=(d_1+d_2)^2+d_4^2-2(d_1+d_2)d_4 \cos [\text{pi}/2-\arcsin((w_h/2)/d_4)]$$

$$d_7^2=(d_1+d_2+d_3)^2+d_4^2-2(d_1+d_2+d_3)d_4 \cos [\text{pi}/2-\arcsin((w_h/2)/d_4)]$$

Some of the variables in these expressions for $d_6$ and $d_7$ are known on the basis of the physical dimensions of the compact loudspeaker of interest. Specifically, $d_1$, $d_2$ and $d_3$ are known. Referring to FIGS. 2A and 4, for the exemplary embodiment of compact speaker product 100, $d_1$ is the lateral or transverse distance (along the Speaker Axis SA) between the center of loudspeaker enclosure 101 and the acoustic center of each of the left and right "main" transducers (108LMS, 108RMS). In this exemplary embodiment, the left and right "main" transducers (108LMS, 108RMS) are symmetrically configured about the center (EC) of loudspeaker enclosure 1, which is placed at the intersection of the listening axis LA and the Speaker Axis SA. Referring again to FIG. 4, $d_2$ is the distance between the acoustic center of each "main" speaker (e.g., 108LMS) and its corresponding effects or SDA speaker (e.g., 108LSS) so $d_2$ in this example is less than 5 inches and preferably about 3.5 inches, and $d_3$, the distance between the acoustic center of each actual effects or SDA speaker (e.g., 108LSS) and its corresponding "phantom" acoustic center in this example is about 4 inches.

The width of the human adult head ($w_h$, or ear separation distance) is known to be approximately 6.5 inches (16.51 cm). Using that constant value for $w_h$, along with $d_1$=1.5 inches, $d_2$=3.5 inches and $d_3$=4.0 inches for the compact loudspeaker 100 permits computation of ear-to-effects distances $d_6$ and $d_7$ as a function of the independent variable $d_{listen}$ (on which $d_4$ depends). Then, $d_7-d_6$, the distance differential associated between the phantom location of the SDA transducer ($d_7$) and the main transducer ($d_6$) may be computed, from which the time of arrival difference may be derived. Delta-t=(d7−d6)/c, where c=speed of sound in air at sea level at 20 deg C.=340 m/s. The results of this computation are shown in Table 1 for a range of listening distances $d_{listen}$ or ($d_1$) in meters.

TABLE 1

| d-listen (m) | delta t (ms) | ratio 0.3 ms/delta-t |
|---|---|---|
| 1.0 | 2.829847E−02 | 10.60 |
| 1.5 | 1.892600E−02 | 15.85 |
| 2.0 | 1.421040E−02 | 21.11 |
| 2.5 | 1.137419E−02 | 26.38 |
| 3.0 | 9.481117E−03 | 31.64 |

TABLE 1-continued

| d-listen (m) | delta t (ms) | ratio 0.3 ms/delta-t |
|---|---|---|
| 3.5 | 8.128009E−03 | 36.91 |
| 4.0 | 7.112750E−03 | 42.18 |

For Table 1:

Result of calculated optimal delay value (detailed above), "delta-t", and its ratio in comparison to a subjectively determined optimal delay applied to the SDA transducers of 0.3 ms for a range of listening distances. Note that the optimal delay, as determined by subjective listening using a wide range of program material with which test listeners were familiar, is some 20 to over 40 times longer for common listening distances of 2.0-4.0 m than the expected optimal delay as determined by the computation illustrated in FIG. 4 and described above.

Employing the methods illustrated in FIGS. 4A-4E, Table 1 tabulates the nominal "ideal" delay values for a range of listening distances $d_L$ ranging from 1.0 m to 4.0 m in 0.5 m increments. Delay values range from approximately 28.3 to 7.1 micro-seconds (infinitesimally small periods of time that vary in inverse proportion to listening distance). These initial estimates for delays, while reasonable from an analytical perspective, proved in testing to be surprisingly ineffective.

Instead, applicant's experiments with prototypes (subjective listening tests with trained listeners) revealed that substantially longer delays applied to the SDA (or effects) transducers (108LSS and 108RSS, as shown in FIGS. 2A, 2B and 3), at least one order of magnitude larger, resulted in dramatic improvements in acoustic image breadth in comparison to the computed, theoretical ideal delay. That preferred delay value is in the range of 0.2 to 0.5 ms and preferably 0.3 ms (or approximately 21 to over 40 times longer than the theoretical ideal delay) for common listening distances. This surprising result indicates that simply following the prescriptive computation illustrated in FIG. 4A fails to achieve the promise of SDA which may be much more fully realized when delay values within the range of 0.2-0.5 ms are employed. For the particular loudspeaker assembly of the present invention (e.g., 100), and for listening distances of 2-4 meters, the 0.3 ms delay achieved the most satisfactory results.

SDA processing may be applied to both front and surround channels though additional processing to the surround channels helps to further distinguish (differentiate) those channels' sound reproduction from that of the front channels. In particular, Head Related Transfer Functions ("HRTFs")—magnitude response curves that reflect the effects of the gross and fine features of the human head, ears and torso on sound as received at the eardrum—may be employed to create "phantom" acoustic sources (e.g., SDA Phantom, as shown in FIG. 4A) where none actually exist. HRTFs for both front-to-back and enhanced height (elevation) localization are employed in the surround channels for this purpose.

Figure 4B:
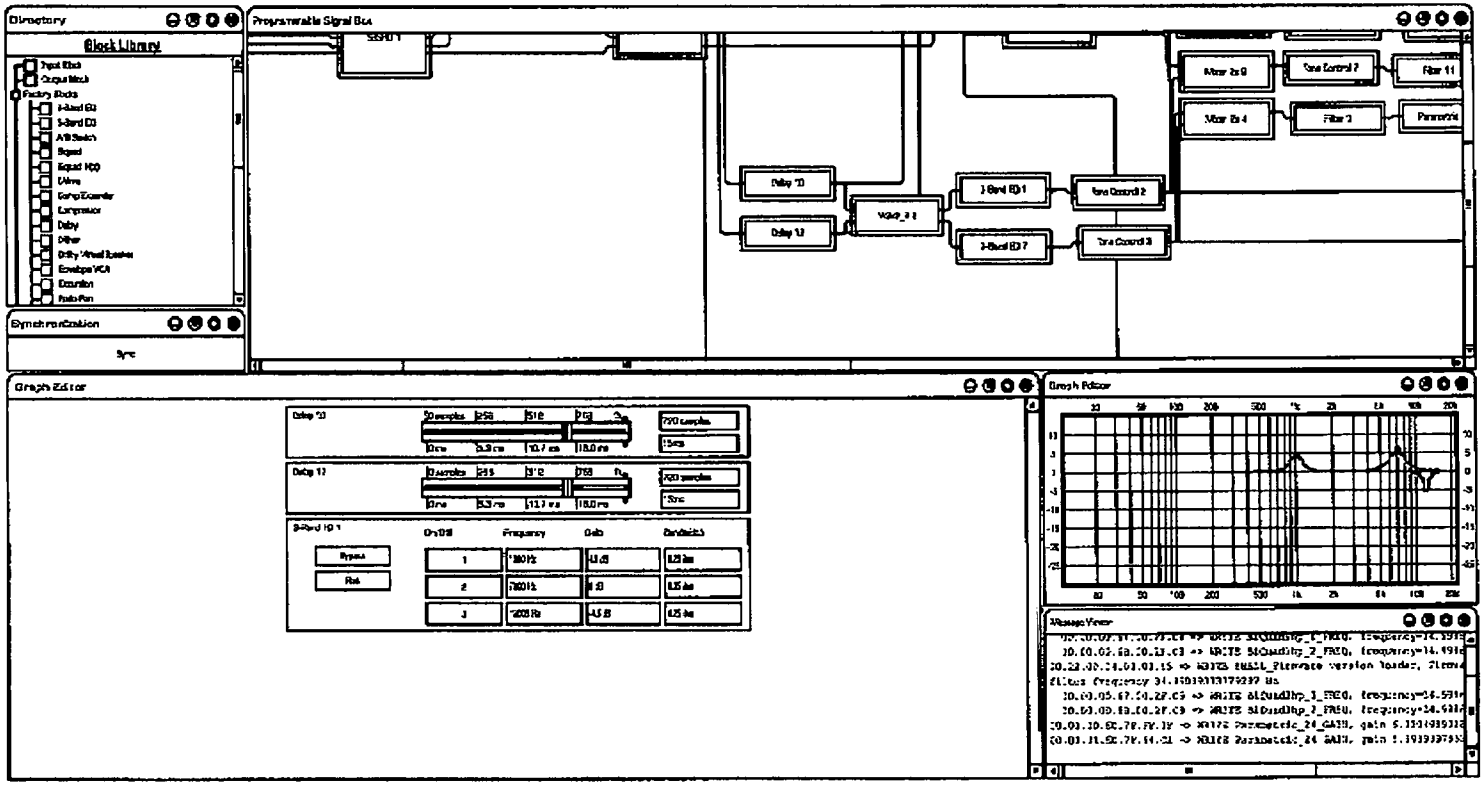
FIG. 4B is a screenshot of a Digital Signal Processing ("DSP") design software application illustrating DSP instructions and a magnitude response curve for selected filtering to provide an inverse Head Related Transfer Function (HRTF) for surround channels, in accordance with the method of the present invention.
Figure 4C:
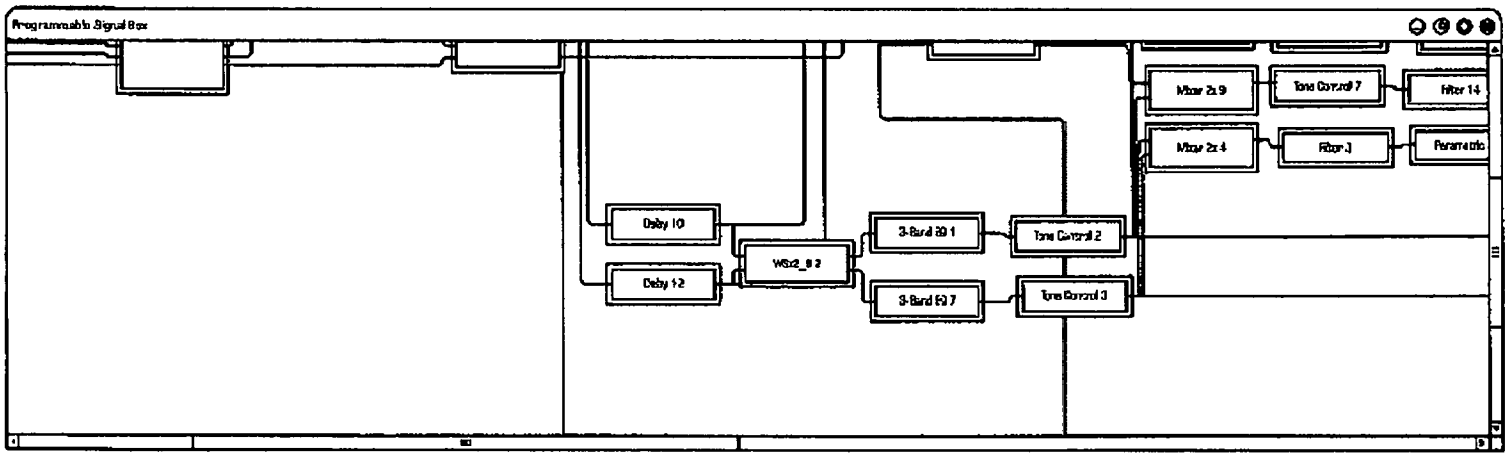
FIG. 4C is a portion of the screenshot of FIG. 4B illustrating the DSP design software application's rendering of functional blocks and signal flow for the DSP instructions and selected filtering to provide the inverse Head Related Transfer Function (HRTF) for surround channels, in accordance with the method of the present invention.
Figure 4D:
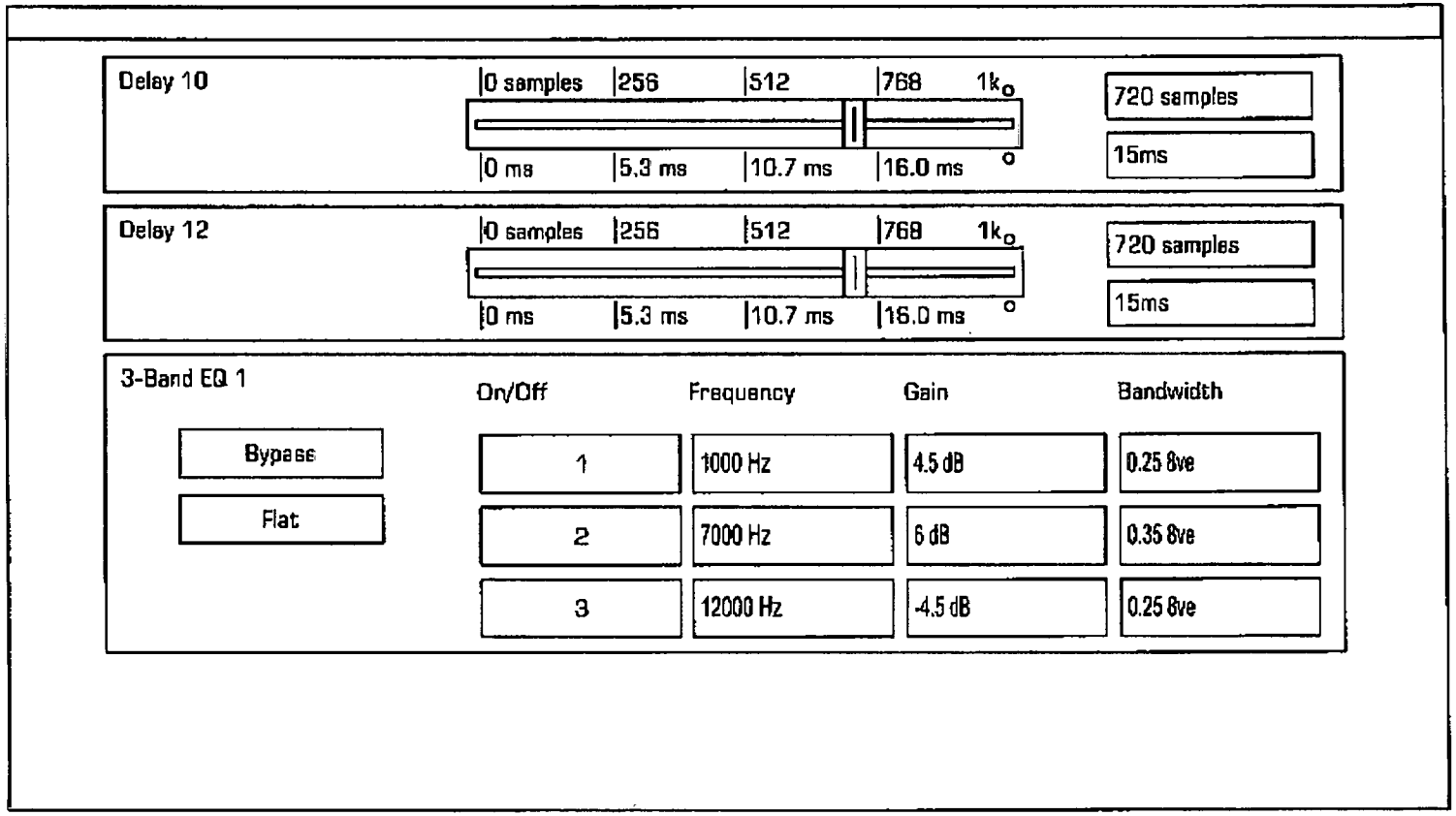
FIG. 4D is another portion of the screenshot of FIG. 4B illustrating the DSP design software application's adjustments for delay and EQ functional blocks to provide the inverse Head Related Transfer Function (HRTF) for surround channels, in accordance with the method of the present invention.
Figure 4E:
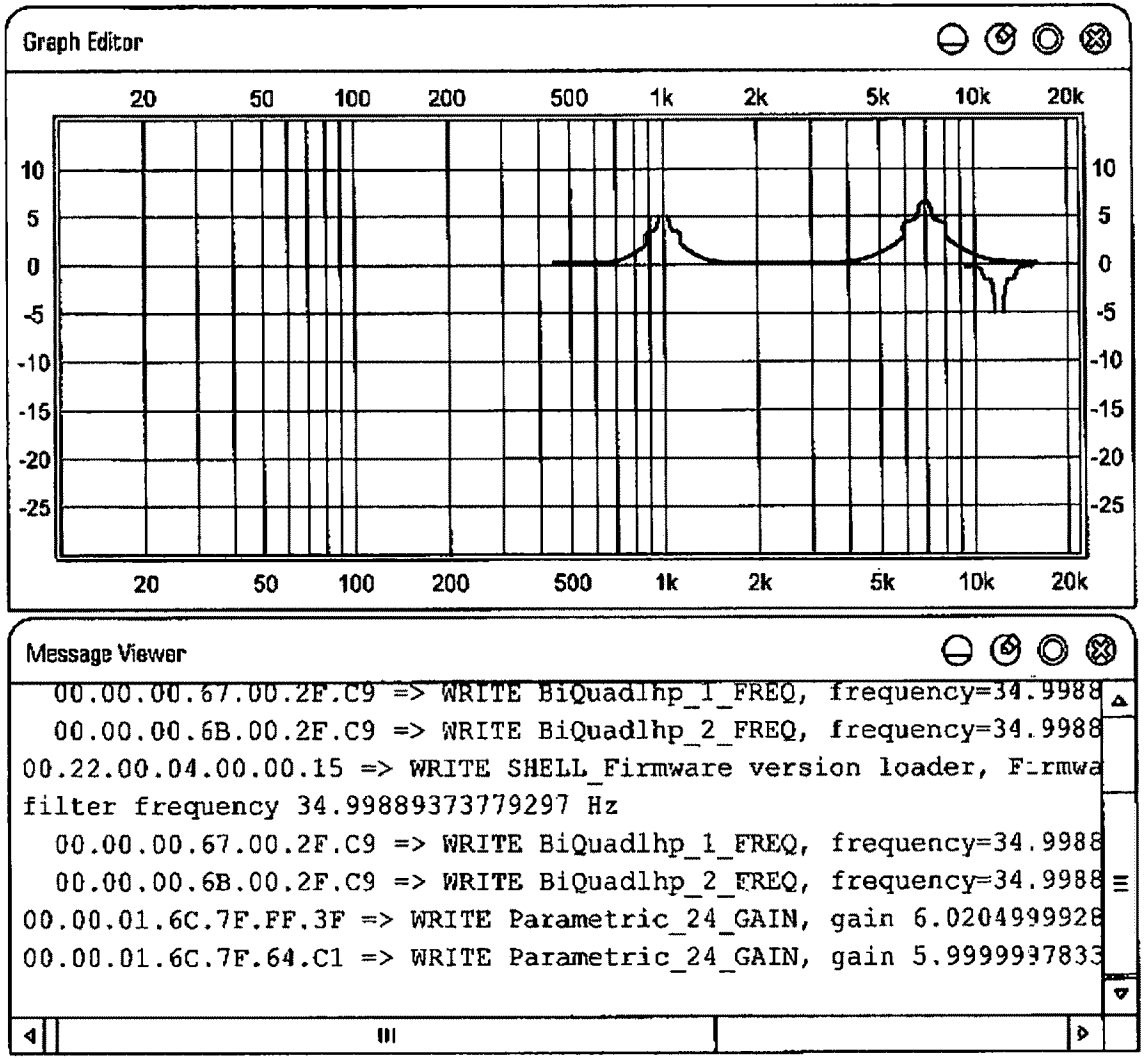
FIG. 4E is a portion of the screenshot of FIG. 4B illustrating the DSP design software application's selected filtering to provide the magnitude response curve desired to effectuate the inverse Head Related Transfer Function (HRTF) for surround channels, in accordance with the method of the present invention.

The magnitude response curves associated with these HRTFs are shown in FIGS. 4B and 4E along with the parametric equalizer settings required for achieving those magnitude response curves. FIG. 4B is a screenshot of a Digital Signal Processing ("DSP") design software application illustrating DSP instructions and a magnitude response curve for selected filtering to provide an inverse Head Related Transfer Function (HRTF) for surround channels, for compact system 100, in accordance with the method of the present invention. FIG. 4C is a portion of the screenshot of FIG. 4B illustrating the DSP design software application's rendering of functional blocks and signal flow for the DSP instructions and selected filtering to provide the inverse Head Related Transfer Function (HRTF) for surround channels, and FIG. 4D is another portion of the screenshot of FIG. 4B illustrating the DSP design software application's adjustments for delay and EQ functional blocks to provide the inverse Head Related Transfer Function (HRTF) for surround channels. FIG. 4E is a portion of the screenshot of FIG. 4B illustrating the DSP design software application's selected filtering to provide the magnitude response curve desired to effectuate the inverse Head Related Transfer Function (HRTF) for surround channels.

In applicant's work, it has been confirmed that a 1.0 kHz boost induces a listener's sense of ambiguity with regard to front vs. rear source location while the combined effect of a 7.0 kHz peak followed by a 12.0 kHz notch (see, e.g., the settings shown in FIG. 4D and the resulting magnitude response plot of FIG. 4E) elevates the listener's sense of certainty about the apparent location of audio sources (see, e.g., Dolby® Atmos® specifications and HRTF libraries).

Figure 6:
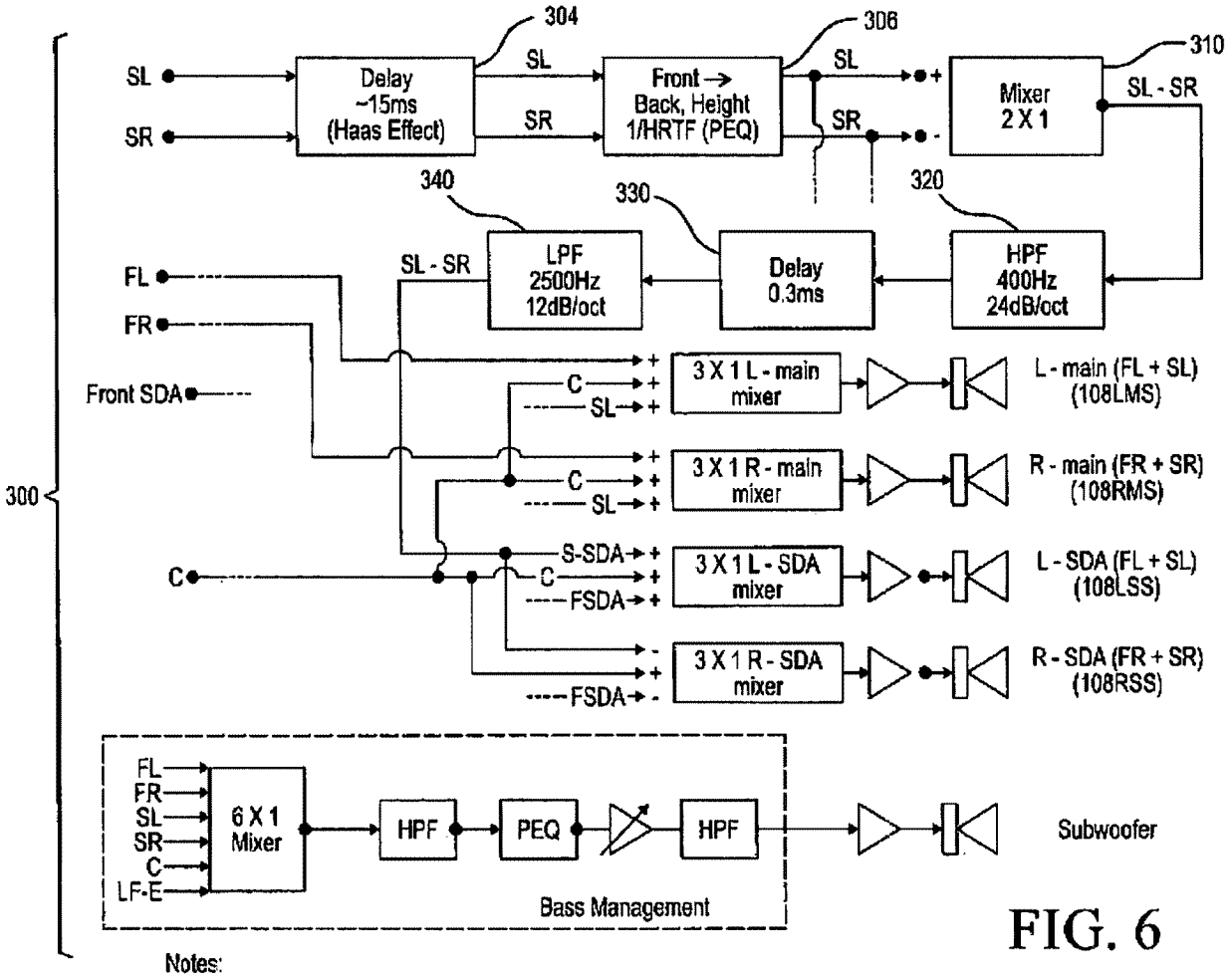
FIG. 6 is a block diagram illustrating the compact SDA signal processing method for generating 5.1 or home theater (i.e., nominally, left channel, center channel, right channel, left surround channel, right surround channel and corresponding effects) signals for loudspeaker drivers, in accordance with the present invention.

An enhancement which enables the listener to better differentiate the surround channel reproduction from the front is realized by applying a selected delay to the surround channel signals. In this manner, the apparent surround channel acoustic sources are located further away from the actual loudspeaker in accordance with the time delay setting. The system 100 and method of the present invention use a delay of 8-25 ms applied to the surround channel signals (SL and SR, as illustrated in FIG. 6) and the delay signal processing is employed on the full-range of those channels (meaning the entire spectrum of the surround channel signals are delayed equally). For this reason, if a subwoofer (not shown) reproduces the low-frequency portion of the surround channels, its reproduction should be delayed by a duration equal to that of the higher frequency portion of the surround channels (e.g., 8-25 ms). A similar delay should be applied for any intermediate frequency range or extreme high frequency range (i.e., as reproduced by tweeters 109L and 109R, best seen in FIGS. 2A and 3).

Figure 5:
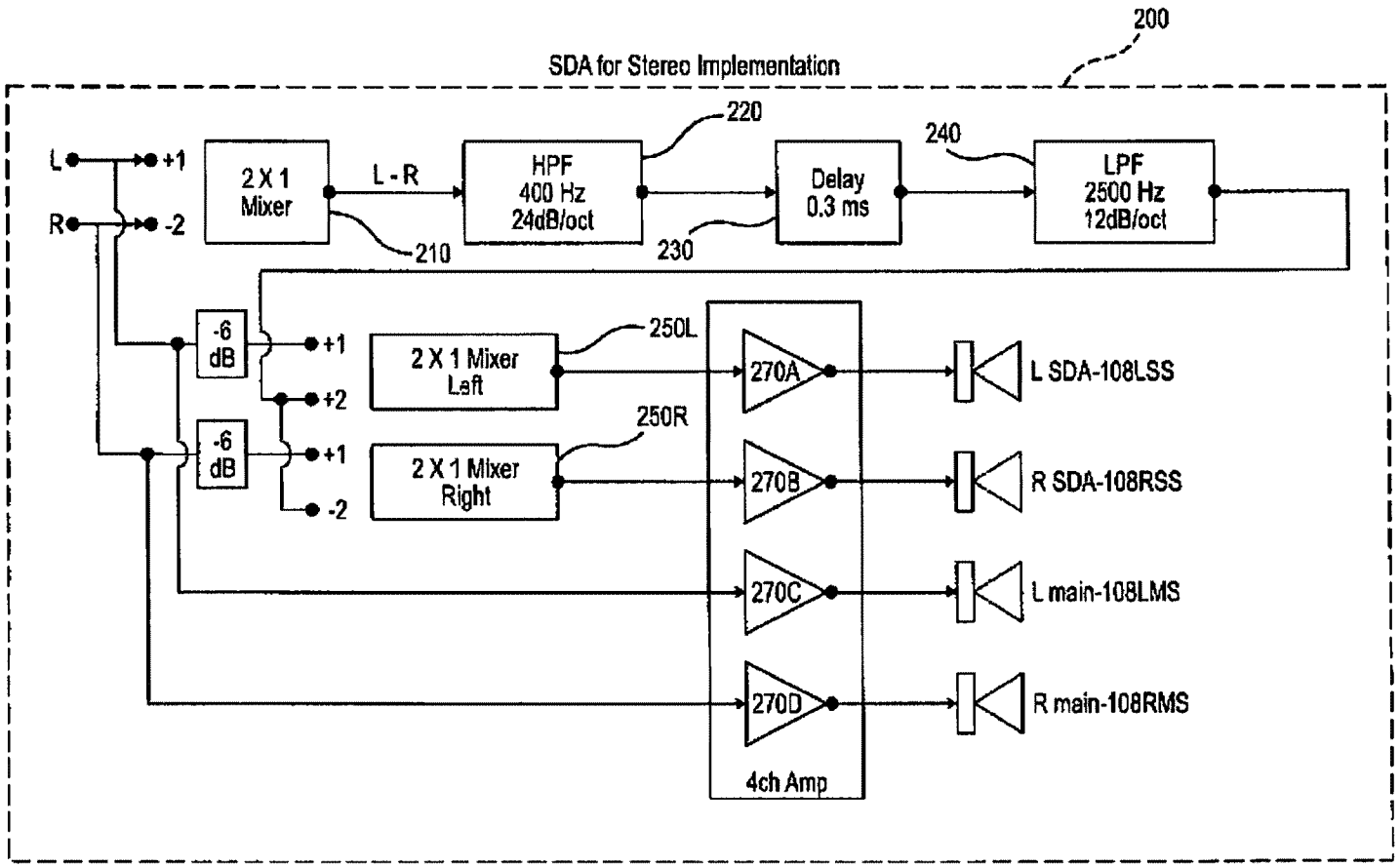
FIG. 5 is a block diagram illustrating the compact SDA signal processing method for generating stereo (i.e., nominally left channel, right channel and effects) signals for loudspeaker drivers, in accordance with the present invention.

Referring now to FIG. 5, the signal processing methods of the present invention can be illustrated by reviewing a block diagram which illustrates a Stereo Compact SDA system 200 with stereo (e.g., Left and Right channel music playback) signals. The algorithm for stereo SDA as applied to compact loudspeaker systems (e.g., like system 100) begins with deriving a difference signal between the Front Left and Front Right channels (designated "L" and "R" in the upper left portion of FIG. 5, respectively). By inverting the R channel's polarity, as indicated by the minus sign ("−") shown at its input terminal, the 2×1 Mixer 210 does so by subtracting the R channel from the L channel. Note that the L channel's input is designated as positive ("+") indicating that its polarity is not inverted. Thus, the output of the 2×1 Mixer, as indicated, is "L−R" (or "L minus R"). Next, the so derived L−R difference signal is subjected to a high-pass filter 220 that is set to 400 Hz and whose filter order is 24 dB per octave (i.e. 4th order), though it may be appreciated that lower order filters may be found to be effective and, similarly, filters set to somewhat lower or higher frequencies also may be found to be effective. Next, delay block 230 delays that signal by a selected delay interval in the range of 0.2 ms-0.5 ms, this delay is imposed on the L−R difference signal as a means of acoustically appearing to "re-locate" the SDA effect loudspeakers to their preferred "phantom" locations. The methods for determining the delay value are described above. A lower order low-pass filter 240 (12 dB/octave) set to 2.5 kHz follows the delay block 230, to minimize listener perceived problems with "phasiness" and instability in the sonic images comprising the soundscape. By experimentation, the applicant has demonstrated that when the SDA signal's bandwidth extends too high in frequency, easily perceived problems with phasiness and image instability result, and the LPF filter 240 works well for this exemplary embodiment. Again, it may be appreciated that lower or higher order filters may be found to be effective (12/dB octave is exemplary but is optimal for the illustrated system) and the LPF frequency may be effective when set to a somewhat lower or higher frequency, but the preferred embodiment is illustrated in FIG. 5. After splitting the L−R difference signal, it is fed to each of a pair of 2×1 Mixers, one of which is designated Left Mixer 250L and the other Right Mixer 250R. These mixers are identical except for the Right mixer's input terminal whose #2 input is designated as negative, thereby indicating polarity inversion of the L−R signal within that Mixer. Note the Left Mixer's L−R input retains positive polarity. That the Right 2×1 Mixer inverts the L−R signal means that a "−L" (minus L) signal component is fed to the Right SDA or effects loudspeaker (e.g., 108RSS), thereby cancelling interaural crosstalk from the opposing stereo Main (Left) loudspeaker (e.g., 108LMS). Similarly, the output of the Left 2×1 Mixer includes a "−R" signal component which effectively cancels +R from the opposing stereo Main (Right) loudspeaker (e.g., 108RMS). As indicated, both the Left and Right 2×1 Mixers accept attenuated Left and Right channel signals (additional signal processing on those signals, which generally include HPFs, parametric equalization and LPFs, is not shown here). These attenuated signals, L and R respectively mixed to the L and R 2×1 mixers, help to stabilize SDA acoustic images. While the attenuation level in the block diagram is shown as 6 dB, it may be appreciated that larger or smaller values may be effective depending on the application or for various sound modes (e.g. "movie" or "music") and the desired sound effect. Finally, as shown, L and R signals are fed to the L and R main loudspeakers (e.g., 108LMS and 108RMS).

It will be appreciated by persons of skill in the art that a compact system 100 with SDA system 200 implementing the method of present invention as illustrated in FIGS. 2A-5 includes a novel combination of features and signal processing method steps, including, for exemplary compact loudspeaker system or product 100, (a) at least a first enclosure 1 having a front baffle surface alignable along a speaker axis SA and terminating on opposing lateral or angled sides with substantially transverse or angled left and right sidewall surfaces (system 100 could also be configured as a pair of small enclosures extending from somewhere near the intersection of the listening axis LA and the speaker axis SA, shown as EC in FIG. 4A, where each small enclosure fixes the $d_2$ spacing between its own main and effects loudspeaker driver);

(b) a first, left-main loudspeaker driver 108LMS, (c) a second, right main loudspeaker driver 108RMS, (d) a third, left sub/effect loudspeaker driver 108LSS having its acoustic center spaced laterally from said first loudspeaker driver 108LMS by a distance $d_{2L}=d_2$ of less than five and one half inches (e.g., 3.5 inches, as seen in FIGS. 2A-4A), (e) fourth, right sub/effect loudspeaker driver 108RSS having its acoustic center spaced laterally from said second loudspeaker driver 108LMS by a distance $d_{2R}=d_2$ of less than five and one half inches (e.g., 3.5 inches), (f) L and R signal inputs (best seen in FIG. 5), signal processing and $1^{st}$-$4^{th}$ amplifiers (e.g., 270A, 270B, 270C, 270D) connected to said first-fourth loudspeaker drivers, including (f1) a mixer 210 receiving the L and R signals with a means to invert the R signal (preferably by inverting the subtracted R signal, as illustrated in FIGS. 4B and 5) for generating an L−R signal, (f2) a filter 220 for generating a filtered L−R signal, (f3) a delay circuit 230 configured to receive the L−R signal and provide a selected delay in the range of 50 microseconds to 0.5 milliseconds (preferably 0.3 ms, as shown in FIG. 5) for generating a delayed L−R signal, and (f4) Left Effect and Right Effect amplification stages for generating amplified Left Effect and Right Effect signals from said delayed L−R signal, where the Left Effect and Right Effect signals are used to drive the third, left sub/effect loudspeaker driver 108LSS and said fourth, right sub/effect loudspeaker driver 108RSS with corresponding compact SDA effect generating signals.

System 100 also includes the HPF and LPF filtering needed to make the compact SDA sonic image stable and satisfying, since, as described above, when the SDA signal's bandwidth extends too high in frequency, phasiness and instability results.

Turning next to the method of the present invention, as applied in a home theater playback setting, FIG. 6 illustrates the signal processing system 300 and method steps for applying Compact SDA processing to audio signals in a 5.1 system. SDA signals for the FL and FR channels are derived and generated as described above for the stereo Left and Right channels (and as illustrated in FIGS. 4A and 5). The signal processing method and circuitry 300 developed to generate Compact SDA for the Surround channels is illustrated in FIG. 6, where the algorithm for 5.1 channel SDA as applied to compact loudspeaker systems (e.g., 100) begins with a delay block 304 imposing a time delay of 10 ms-20 ms in order to disassociate the surround channel signals (SL, SR) from the front channels (FL and FR). To the extent that front and surround channels share certain program elements, this time delay, by exploiting the well-known "Haas" or precedence effect, helps to ensure that surround channel effects will be localized (by the listener) as intended. Next, the delayed SL and SR signals are subjected to a set of parametric equalization ("PEQ") filters 306 that together will both elevate and move the apparent location of the acoustic source from the front (nearer the Speaker Axis SA) to the back (farther from the Speaker Axis SA as seen in FIG. 4, preferably behind the listener's head).

These filter shapes are derived from inverse head related transfer functions (HRTFs) which have been simplified for effective application to the general population. Next, the difference signal between the SL and SR channel is derived within 2×1 Mixer 310 by inverting the SR channel's polarity, as indicated by the minus sign ("−") shown at its input terminal. The 2×1 Mixer 310 does so by subtracting the SR channel from the SL channel. Note that the SL channel's input is designated as positive ("+") indicating that its polarity retained (i.e. not inverted). Thus, the output of the 2×1 Mixer 310, as indicated, is "SL−SR" (or "SL minus SR"). Next, the output signal from Mixer 310 is subjected to a high-pass filter 320 that is set to 400 Hz and whose filter order is 24 dB per octave (i.e. 4th order), though it may be appreciated that lower order filters may be found to be effective and, similarly, filters set to somewhat lower or higher frequencies also may be found to be effective. Next, a delay of 0.2 ms-0.5 ms is imposed by delay block 330 on the SL−SR difference signal as a means of "re-locating" a listener's sense of the SDA effect loudspeakers to their preferred phantom positions. The method by which the delay value is ascertained is described above (as relates to FIG. 4A). A lower order low-pass filter 340 (12 dB/octave) set to 2.5 kHz follows delay block 330. Again, it may be appreciated that lower or higher order filters may be found to be effective (12/dB octave is exemplary but known to optimal for certain applications) and the LPF frequency may be effective when set to somewhat lower or higher frequencies. Next, the filtered SL−SR difference signal generated in filter block 340 is split and sent to a pair of 3×1 Mixers which are designated "L-SDA" and "R-SDA". These mixers are identical except for the R-SDA mixer's polarity inversion of the SL−SR difference signal as indicated by the negative sign ("−") at the associated input.

Note that the L-SDA's SL−SR input retains positive polarity. That the R-SDA's 2×1 Mixer inverts the SL−SR signal means that a "−SL" (minus SL) signal component is fed to the Right SDA loudspeaker, thereby cancelling inter-aural crosstalk from the opposing stereo Main (Left) loudspeaker. Similarly, the output of the L-SDA 2×1 Mixer includes a "−SR" signal component which effectively cancels+SR from the opposing stereo Main (Right) loudspeaker signal. Not shown are attenuator blocks associated with both the FL/FR and SL/SR signals that feed the four mixers shown in FIG. 6. An attenuation value of 6 dB has been shown to be effective for acoustic image stabilization, but it should be appreciated that larger or smaller values also may be effective depending on the application and for various sound modes (e.g. "movie" or "music") and the desired sound effect. As indicated, the L-main and R-main 3×1 Mixers accept Front Left and Front Right channel signals though additional signal processing on those signals, which generally includes HPFs, parametric equalization and LPFs, is not shown here.

The Center channel signal, also post processed via various filters, gain controls and PEQs that are not shown here (e.g., in accordance with commonly owned U.S. Pat. No. 9,374,640) is reproduced by not only the L/R-main loudspeakers (108LMS, 108RMS) but also the L/R-SDA loudspeakers (108LSS, 108RSS) by virtue of their dedicated 3×1 mixers. Finally, in the illustrated embodiment, Compact SDA system 100 is adapted for use with a separate external subwoofer (e.g., such as the applicant's own Polk® MagniFi Mini™ wireless powered subwoofer, not shown). The subwoofer channel's bass-management is achieved by summing FL, FR, SL, SR, C and LFE (low-frequency effects) via a 6×1 Mixer and processing the output as shown at the bottom of FIG. 6, so following the mixing stage are a HPF (set to eliminate subsonic and out-of-band low-frequency artifacts), PEQ (parametric equalization) to ensure smooth acoustic response through the passband and crossover region, a variable gain stage and a low-pass filter set appropriately in accordance with the companion active subwoofer loudspeaker system (not shown).

Persons of skill in the art will appreciate that the present invention provides a single enclosure multi-channel loudspeaker very compact multi-driver loudspeaker system or product 100 with a novel signal processing system and method to achieve a surprisingly effective psycho-acoustically expanded image breadth by inter-aural crosstalk cancellation, in a manner which relies on a new method for cancellation of apparent sources of inter-aural crosstalk (i.e., where the left SDA effect transducer 108LSS is driven with an L–R difference signal and cancels interaural crosstalk from the right main transducer 108RMS while the right SDA effect transducer 108RSS is driven with an R–L difference signal and cancels interaural crosstalk from the left main transducer 108LMS). In the commonly owned Polk® SDA™ (prior art) method of the prior patents cited above (and incorporated by reference here), the optimal distance between stereo pair main and effect (SDA) loudspeakers was required to be substantially equal to the ear-to-ear width of a typical user's head (e.g., about 7-8 inches). Compact SDA speaker system 100 employs digital signal processing methods (as illustrated in FIGS. 4A-6) including surprisingly long time delays to acoustically simulate the optimal placement of an SDA effect speaker relative to its main companion speaker, for a physically compact configuration having each side's "main" transducer (e.g., 108LMS) spaced at less than 5.5 inches from the side's corresponding SDA (or effects) transducer (e.g., 108LSS), which permits the system enclosure to be surprisingly compact, (e.g., width of as little as 341.2 mm) while providing a realistic ambient field and acoustic image for listeners in a listening space including the listening location. The surprisingly effective psycho-acoustically expanded image breadth is generated by cancelling interaural crosstalk from L and R signals.

In the illustrated embodiment, substantially full range audio playback is achieved with compact yet powerful left and right "main" transducers (108LMS, 108RMS) and SDA (or effects) transducers (108LSS and 108RSS, as shown in FIGS. 2A, 2B and 3) when spaced close together with left and right tweeters 109L and 109R along the enclosure's front baffle's surface which is aligned along a speaker axis SA and defines a lateral baffle width of less than 400 mm (preferably about 341.2 mm) terminating on opposing lateral sides with substantially transverse or angled left and right sidewall surfaces. The compact loudspeaker system's front baffle surface projects upwardly from planar base plate member 105 and defines an upwardly projecting baffle surface having a baffle height of about 78.5 mm, while supporting and aiming left and right "main" transducers (108LMS, 108RMS) and SDA (or effects) transducers (108LSS and 108RSS, as shown in FIGS. 2A, 2B and 3) spaced close together with left and right tweeters 109L and 109R as illustrated in FIGS. 2A-3.

Having described preferred embodiments of a new and improved system and signal processing method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A System for implementing Stereo Dimensional Array signal processing in a compact multi-channel loudspeaker product defined along a Speaker Axis configured for use when bisected by a perpendicular listening axis that also intersects a listening location for generating a psycho-acoustically expanded sonic image breadth for listeners in a listening space including the listening location, comprising:

(a) a first enclosure having a front baffle surface aligned in parallel with the Speaker Axis and terminating on opposing lateral sides with substantially transverse left and right sidewall surfaces;

(b) a first, left-main forward facing loudspeaker driver supported within said first enclosure and aligned on said Speaker Axis and aimed toward said listening location, (c) a second, right main forward facing loudspeaker driver supported within said first enclosure and aligned on said Speaker Axis and aimed toward said listening location, (d) a third, left sub/effect loudspeaker driver supported within said first enclosure and aligned on said Speaker Axis and having its acoustic center spaced laterally from said first loudspeaker driver by a distance d2L of less than 5.5 inches, (e) a fourth, right sub/effect loudspeaker driver supported within said first enclosure and aligned on said Speaker Axis and having its acoustic center spaced laterally from said second loudspeaker driver by a distance d2R of less than 5.5 inches, (f) said compact multi-channel loudspeaker product further comprising L and R signal inputs, signal processing circuitry responsive to said L and R inputs for generating a L main signal, a R main signal, a L SDA signal including an L–R difference signal to cancel interaural crosstalk from the second right main loudspeaker driver 108RMS, and a R SDA signal including an R–L difference signal to cancel interaural crosstalk from the first left main loudspeaker driver 108LMS, and first, second third and fourth amplifiers configured to amplify said L main signal, said R main signal, said L SDA signal and said R SDA signal, wherein said first, second, third and fourth amplifiers are connected to said first, second, third and fourth loudspeaker drivers;

(g) wherein said signal processing circuitry further comprises a mixer receiving the L and R signals for generating an L–R signal, a filter for generating a filtered L–R signal, and a delay circuit configured to receive the L–R signal and provide a selected delay in the range of 50 microseconds to 0.5 milliseconds for generating a delayed L–R signal;

(h) wherein said compact multi-channel loudspeaker product enclosure has a lateral width of less than 400 mm and terminates on opposing lateral sides with said left and right sidewall surfaces; and (i) wherein said compact multi-channel loudspeaker product reproduces audio program material with a realistic ambient field and acoustic image for listeners in a listening space including the listening location by cancelling interaural crosstalk from L and R signals.

2. The System for implementing Stereo Dimensional Array signal processing in a compact multi-channel loudspeaker product of claim 1, wherein said filter for generating filtered L–R signal comprises a High Pass Filter HPF configured to pass signals above 400 Hz.

3. The System for implementing Stereo Dimensional Array signal processing in a compact multi-channel loudspeaker product of claim 2, wherein said filter for generating said filtered L–R signal comprises a High Pass Filter HPF configured to pass signals above 400 Hz and roll off at 24 dB per Octave and a Low Pass Filter LPF configured to pass signals below 2500 Hz and roll off at 12 dB per Octave.

4. The System for implementing Stereo Dimensional Array signal processing in a compact multi-channel loudspeaker product of claim 1, wherein said third, left sub/effect loudspeaker driver having its acoustic center spaced laterally from said first loudspeaker driver by a distance d2L, where said distance d2L is less than four inches.

5. The System for implementing Stereo Dimensional Array signal processing in a compact multi-channel loudspeaker product of claim 1, wherein said third, left sub/effect loudspeaker driver having its acoustic center spaced laterally from said first loudspeaker driver by a distance d2L of 3.5 inches.

6. The System for implementing Stereo Dimensional Array signal processing in a compact multi-channel loudspeaker product of claim 1, wherein said delay circuit is configured to receive the L−R signal and provide a selected delay in the range of 0.2 to 0.5 milliseconds for generating a delayed L−R signal.

7. The System for implementing Stereo Dimensional Array signal processing in a compact multi-channel loudspeaker product of claim 6, wherein said delay circuit is configured to receive the L−R signal and provide a selected delay of 0.3 milliseconds for generating the delayed L−R signal.

8. The System for implementing Stereo Dimensional Array signal processing in a compact multi-channel loudspeaker product of claim 7, wherein said first enclosure front baffle surface aligned along said speaker axis SA defines a lateral baffle width of approximately 341.2 mm and terminates on opposing lateral sides with said substantially transverse left and right sidewall surfaces.

9. The System for implementing Stereo Dimensional Array signal processing in a compact multi-channel loudspeaker product of claim 8, wherein said first enclosure front baffle surface aligned along said speaker axis SA projects upwardly from a base plate member and defines an upwardly projecting baffle surface having a baffle height of about 78.5 mm.

10. The System for implementing Stereo Dimensional Array signal processing in a compact multi-channel loudspeaker product of claim 1, further comprising:

(j) a Left Surround signal input and Left Surround signal processing circuitry responsive to said Left Surround signal input for generating a delayed Left Surround signal;

(k) a Right Surround signal input and Right Surround signal processing circuitry responsive to said Right Surround signal for generating delayed Right Surround signal;

(l) Left and Right Surround Parametric Equalization filters responsive to said delayed Left Surround signal and said delayed Right Surround signal for generating a filtered delayed Left Surround signal and a filtered delayed Right Surround signal;

(m) a Mixer for generating a surround difference SL−SR signal from said filtered delayed Left Surround signal and a filtered delayed Right Surround signal;

(n) SDA surround signal mixer input processing circuitry responsive to said surround difference SL−SR signal for generating filtered, delayed surround difference SL−SR signal for said third, left sub/effect loudspeaker driver and said fourth, right sub/effect loudspeaker driver.

11. The System for implementing Stereo Dimensional Array signal processing in a compact multi-channel loudspeaker product of claim 10, wherein said Left Surround signal processing circuitry responsive to said Left Surround signal generates a delayed Left Surround signal which is delayed by approximately 15 milli-seconds to psycho-acoustically simulate the Haas effect for Left Surround signals when perceived at the listening position.

12. The System for implementing Stereo Dimensional Array signal processing in a compact multi-channel loudspeaker product of claim 11, wherein said Right Surround signal processing circuitry responsive to said Right Surround signal generates a delayed Right Surround signal which is delayed by approximately 15 milli-seconds to psycho-acoustically simulate the Haas effect for Right Surround signals when perceived at the listening position.

13. The System for implementing Stereo Dimensional Array signal processing in a compact multi-channel loudspeaker product of claim 12, wherein said SDA surround signal mixer input processing circuitry responsive to said surround difference SL-SR signal comprises a High Pass filter followed by a delay element implementing a selected delay for the generating filtered, delayed surround difference SL−SR signal for said third, left sub/effect loudspeaker driver and said fourth, right sub/effect loudspeaker driver.

14. The System for implementing Stereo Dimensional Array signal processing in a compact multi-channel loudspeaker product of claim 13, wherein said SDA surround signal mixer input processing circuitry responsive to said surround difference SL−SR signal comprises a High Pass filter configured to pass signals above 400 Hz, followed by the delay element implementing a 0.3 millisecond delay which is then filtered in a Low Pass Filter element configured to pass signals below 2500 Hz for the generating filtered, delayed surround difference SL−SR signal for said third, left sub/effect loudspeaker driver and said fourth, right sub/effect loudspeaker driver.

15. A method for implementing Stereo Dimensional Array signal processing and optimizing a psycho-acoustically expanded sonic image from a compact multi-channel enclosure loudspeaker system, comprising:

(a) providing a compact elongated enclosure configured to support and aim a multi-element loudspeaker line array including left and right "main" transducers and left and right "sub" or effects transducers when spaced close together with left and right tweeters, said enclosure being configured to enclose and support an audio reproduction system configured to generate a left channel main signal a right channel main signal, a left SDA or effects signal, a right SDA or effects signal and a center channel signal;

(b) providing the left main transducer and the right main transducer disposed respectively at left and right main speaker locations in side-by-side positions along a speaker array axis SA defined as a line passing through said left and right main speaker locations, with a listening area comprising the general area in front of the left and right main speaker locations such that the left main speaker location lies to the left and the right main speaker location lies to the right when viewed from the listening area, wherein said left and right main transducers reproduce sound associated with signals received by said left and right main transducers; the left sub transducer and the right sub transducer disposed respectively at left and right sub-speaker locations on laterally spaced opposing sidewalls, wherein the left and right sub-speaker locations lie approximately on the speaker axis SA such that the left and right sub-speaker locations on the left and right angled sidewalls as viewed from the listening area are located to the left and right respectively of the respective left and right main transducer locations with main-sub spacings d2L and d2R; wherein said main-sub spacings d2L and d2R are less than 5.5 inches;

(c) providing signal modification and combination means which are responsive to said first (L) and second (R) audio input signals, (d) generating an L−R signal, (e) delaying the L−R signal and provide a selected delay in the range of 50 microseconds to 0.5 milliseconds for generating a delayed L−R signal, and (f) generating amplified Left Stereo Dimensional Array Effect and Right Stereo Dimensional Array Effect signals from said delayed L−R signal, wherein said Left Stereo Dimensional Array Effect and Right Stereo Dimensional Array Effect signals are used to drive said left sub transducer and said right sub transducer, respectively.

16. The method for implementing Stereo Dimensional Array signal processing and optimizing a psycho-acoustically expanded sonic image from a compact or small single enclosure loudspeaker system of claim 15, further comprising:

(g) reproducing sound associated with said first (L) audio input signal simultaneously through said left and right "sub" or effects transducers, so that said reproduced center channel sound is perceived by the listener located in the listening area to originate from a sound location near said midpoint of said speaker array axis.

17. The method for implementing Stereo Dimensional Array signal processing and optimizing a psycho-acoustically expanded sonic image from a compact or small single enclosure loudspeaker system of claim 15, wherein step (e) comprises delaying the L−R signal to provide a selected delay of approximately 0.5 milliseconds for generating a delayed L−R signal when the main-sub spacings d2L and d2R are approximately 3.5 inches.

* * * * *